United States Patent [19]

Hardman

[11] Patent Number: 4,997,688

[45] Date of Patent: Mar. 5, 1991

[54] COVERING SHEET MATERIAL

[75] Inventor: Derek A. Hardman, Chorley, England

[73] Assignee: D. Hardman (Solarfilm) Ltd., Chorley, England

[21] Appl. No.: 294,862

[22] Filed: Jan. 9, 1989

[30] Foreign Application Priority Data

Feb. 5, 1988 [GB] United Kingdom ..... 8802621

[51] Int. Cl.[5] ..... A63H 27/00; B32B 27/04; B32B 31/12; B32B 31/20

[52] U.S. Cl. ..... 428/34.9; 156/71; 156/84; 156/85; 156/86; 156/307.5; 156/307.7; 156/308.4; 156/308.8; 156/310; 156/324.4; 428/283; 428/288; 428/290; 428/308.4; 428/311.5; 428/317.9; 428/340; 428/913; 446/88; 244/133

[58] Field of Search ..... 156/71, 84, 85, 86, 156/307.5, 307.7, 308.4, 308.8, 324.4; 428/283, 288, 290, 308.4, 311.5, 317.9, 340, 913, 34.9; 244/133; 446/88

[56] References Cited

U.S. PATENT DOCUMENTS

| | | | |
|---|---|---|---|
| 2,356,927 | 8/1944 | Grossman | 244/133 |
| 2,414,125 | 1/1947 | Rheinfrank | 244/133 |
| 2,417,586 | 3/1947 | Crosley | 244/133 |
| 3,140,846 | 7/1964 | Lott | 244/133 |

*Primary Examiner*—James C. Cannon
*Attorney, Agent, or Firm*—Alan Ruderman

[57] ABSTRACT

A covering sheet material particularly for covering balsa wood frameworks of model aircraft, comprises a fibrous scrim which is impregnated with a resin solution containing a cross-linking agent and a catalyst. The resin solution may also include a dye or pigment, coloring agent, a filler or a metal powder, to give a desired surface appearance. The scrim may be a heat bonded non-woven fabric of polyester fibres, and the covering sheet may be bonded to the framework using a heat seal adhesive. After bonding, the covering material may be tautened by further heating. The covering material is lighter, stronger and more puncture resistant than conventional doped tissue paper covering materials.

19 Claims, 1 Drawing Sheet

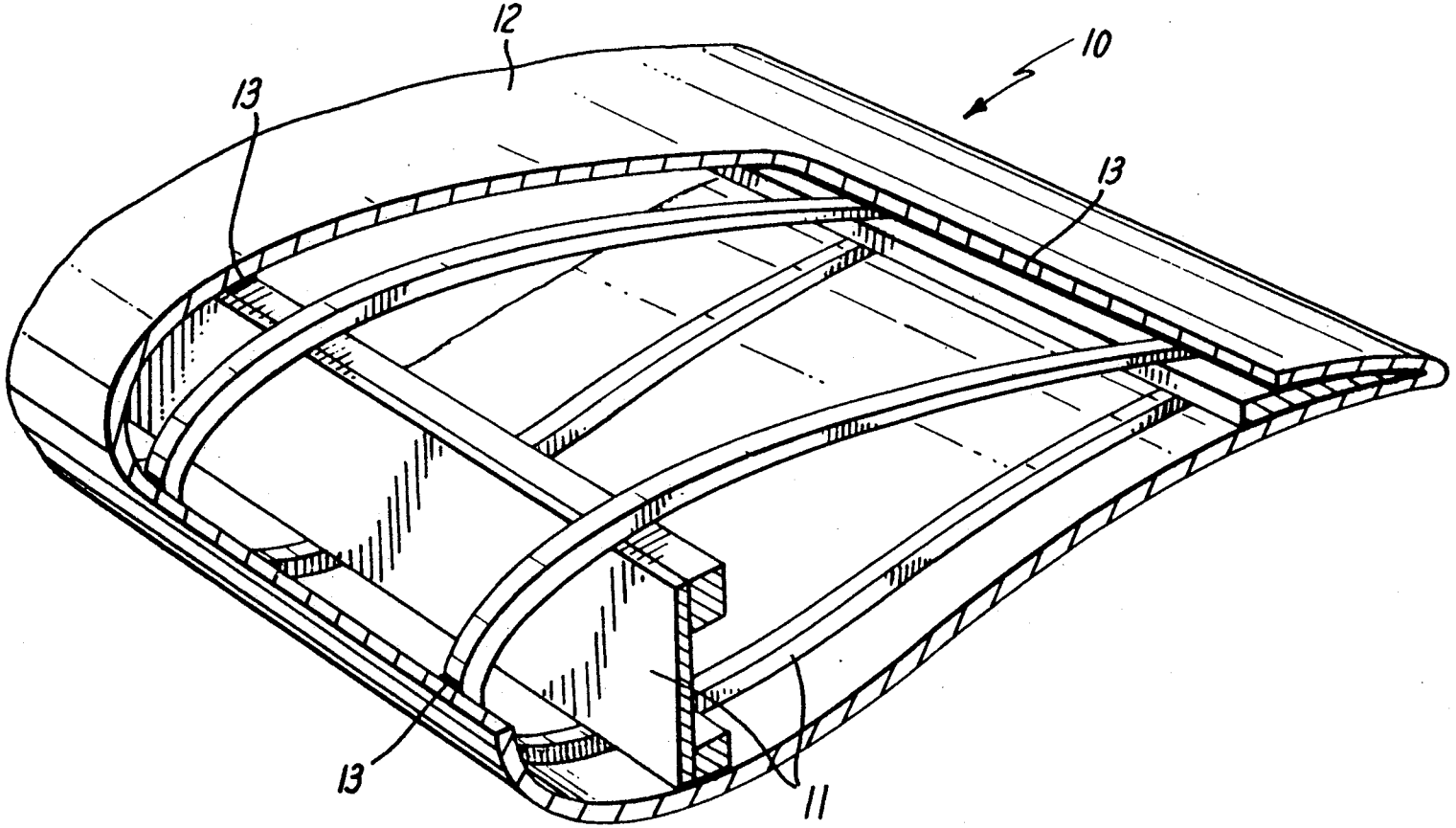
10
13
12
13
11
13

COVERING SHEET MATERIAL

The invention relates to covering sheet material, and in particular to sheet material for covering the frameworks of model aircraft and the like.

Conventionally the framework of model aircraft have been covered with a cellulose based tissue paper. A starch paste or cellulose nitrate solution (dope) may be used as the adhesive between the tissue paper and the balsa wood of the framework. After covering the framework the tissue paper is dampened with water and then allowed to dry so that the tissue paper will shrink on drying and tauten. Since such tissue paper is air porous, the pores are "filled" by "doping", i.e. by coating the paper with a solution of cellulose nitrate (dope) and allowing it to dry. Several coats of dope may be required in order to make the tissue paper "skin" airtight. The doping process also causes the paper to tauten, and sometimes it can tauten too much and distort the framework. However, cellulose based tissue papers are weak and easily punctured or ruptured. The dope is highly inflammable and has a strong odour. Shrinkage of the tissue can continue for several weeks after the doping step, so that the model aircraft may gradually warp and change shape from the original shape as designed and built. Such tautness can be affected by temperature and humidity changes, and in consequence the model aircraft is changing shape slightly as temperature and humidity change, so affecting the flight trim of the model. The "skin" has to be further treated by coating with a fuel-proofing agent if the aircraft is to incorporate an engine and associated fuel. Furthermore, since modellers often require that the model aircraft should reproduce as faithfully as possible the appearance of the actual full-scale aircraft, it is necessary to paint the model after building and doping. The addition of the dope and paint layers adds considerably to the weight of the model, thereby reducing its pay load and/or performance capabilities.

To overcome the abovementioned disadvantages of the weak tissue paper and its porosity, it is known to use as a covering sheet material a laminate of a fibrous scrim and a polyester film. However, such a laminate is relatively heavy and the weight thereof is increased by the application of a layer or layers of paint required if the model is to faithfully reproduce the appearance of a full-scale aircraft. In any event, whether tissue paper or laminate is used, it is very difficult to get a suitable silver paint for use with a model aircraft.

It has also been proposed to use a scrim coated with a heat seal adhesive as a covering sheet material. However, such a material requires painting, giving rise to the aforementioned weight problem, and also requires further weight adding treatments or coatings if it is to resist solvents and/or engine fuels. The adverse effect on the weight of a model aircraft can be gauged from the fact that painting of a scrim of weight 20 grms/m$^2$ can increase its weight to approximately 50 grms/m$^2$.

It is an object of the present invention to provide a covering sheet material which avoids at least to a substantial extent the abovementioned disadvantages.

The invention provides a covering sheet material comprising a fibrous scrim which is impregnated with a resin solution containing a cross-linking agent and a catalyst. The resin solution may also include a colouring agent, which may be a dye or a pigment. Alternatively said resin solution may also include a filler whereby said sheet may be painted or a metal powder whereby said sheet may simulate a sheet of metal. The resin, together with any colouring agent, filler or metal powder therein, may have a weight of between 25% and 100% of the weight of said scrim., preferably between 25% and 50%, and the ratio of the weight of resin to the weight of the colouring agent, filler or metal powder therein may be substantially 9:1. The scrim may have a weight of up to 40 grm/m$^2$ and may be substantially 20grm/m$^2$ in weight. The scrim may be a heat-bonded nonwoven woven fabric of polyester fibres, such as is produced by Bondina Industrial Limited for electrical insulation purposes. The resin may be a polyurethane resin such as "DESMOCOLL 540" (Trade Mark) of Bayer A.G. The cross-linking agent may be DESMODUR (Trade Mark) of Bayer AG and the catalyst may be Dibutyl tin dilaurate. Alternatively in the case of a silver-coloured covering material, the resin may be a PVC/PVA copolymer such as "VINNOL" (Trade Mark) of Wacker-Chemie GmbH. In the latter case, the resin allows silver flakes added thereto at the colouring agent to rise to the surface in quantities sufficient to give the desired silver metallic appearance but not sufficient for substantial quantities thereof to be rubbed off.

The invention also provides a method of covering a framework comprising bonding to such framework, a covering sheet material comprising a fibrous scrim which is impregnated with a resin solution containing a crosslinking agent and a catalyst. The method may also comprise incorporating a colouring agent, which may be a dye or a pigment, in said resin solution prior to bonding said sheet material to said framework. Alternatively, said method may comprise incorporating a filler or a metal powder in said resin solution prior to bonding said sheet material to said framework. The method may comprise impregnating said scrim at least 48 hours prior to bonding said sheet material to said framework. The method may comprise coating said framework with a heat seal adhesive, allowing said adhesive coating to dry, applying said covering material to said framework and applying heat thereto to bond said covering material to said framework. The heat seal adhesive may be a water emulsion of modified vinyl acetate or a vinyl chloride/ vinyl acetate copolymer solution in an organic solvent. The application of heat may comprise heating to substantially 110° C. and may comprise ironing said covering material on said framework. The method may also comprise tautening said covering material on said framework by applying heat thereto, and may comprise heating to between 150° C. and 170° C.

The invention will now be described with reference to the accompanying drawing, which shows part of a wing of a model aircraft, partly cut away.

Referring now to the drawing, there is shown part of a wing 10 of a model aircraft. The wind 10 comprises a framework 11 of balsa wood and a covering 12. In the case of the present invention the covering 12 comprises a fibrous scrim, preferably a heat bonded non-woven fabric of polyester fibres, which is impregnated with a resin solution containing a cross-linking agent and a catalyst. The covering 12 is bonded to the framework 11 by means of a heat seal adhesive 13 which is applied to the framework 11 and allowed to dry before the covering material 12 is applied to the coated framework 11. Bonding of the covering material 12 to the framework 11 is effected by the application of heat, preferably by ironing, and the covering material 12 is tautened by further heating. To give the model 10 a desired appearance, the resin solution incorporated in the covering 12 also includes an additive such as a dye or pigment colouring agent, a filler to provide a base for painting the covering 12, or a metal powder or silver flakes to give a metal surface appearance to the model 10.

By means of the invention an improved covering material for model aircraft and the like is provided. The covering material is up to four times as strong and puncture/rupture resistant than the tissue paper covering materials. No doping is required thereby keeping the weight of the covering material to a minimum and reducing the fire risks, a 20 grm/m$^2$ scrim after impregnation typically weighing between 28 and 30 grm/m$^2$. The covering material of the invention is substantially unaffected by ambient temperature and humidity changes, or by model engine fuels, water or solvents. The present material can be readily stretched whilst hot in order to take up double curvatures.

The amount of resin solution used is sufficient to attach the colouring agent, filler or metal powder to the fibres of the scrim, and should also be sufficient to fill the pores of the scrim and render it airtight when the solvent evaporates. Small amounts of resin provide a relatively matt finish to the covering material, whereas larger amounts of resin provide increasingly glossy finishes to the covering material. If transluscent colours are required, a dye may be added to the resin solution, whereas for more opaque finishes a pigment may be added. The addition of metal powders provides a simulated metal finish and fillers may be added if it is desired to paint the covering material. This latter case is appropriate in the case of the use of heavier scrims, up to 40 grms/m$^2$, to cover sheet balsa framework instead of an open framework. Such covering material may be sanded after application to the sheet balsa framework if desired.

What is claimed is:

1. A covering sheet material for model aircraft, said material comprising a fibrous scrim having a weight not exceeding 40 grm/m$^2$, wherein said fibrous scrim has been impregnated with a resin solution containing a cross-linking agent and a catalyst, the cross-linking agent serving to cross -link the resin and the catalyst serving to promote curing, the resin being at least partially cured.

2. A covering sheet according to claim 1, comprising an additive in said resin solution, said additive comprising a colouring agent.

3. A covering sheet according to claim 1, comprising an additive in said resin solution, said additive comprising a filler.

4. A covering sheet according to claim 1, comprising an additive in said resin solution, said additive comprising a metal powder.

5. A covering sheet according to claim 1, comprising an additive in said resin solution, wherein said resin solution has a weight of between 25% and 100% of the weight of said scrim.

6. A covering sheet according to claim 5 wherein the ratio of the weight of said resin solution to the weight of said additive is substantially 9:1.

7. A covering sheet according to claim 1 wherein said scrim comprises a heat bonded non-woven fabric of polyester fibres.

8. A covering sheet according to claim 1 wherein said resin is a polyurethane resin.

9. A covering sheet according to claim 1 wherein said resin is a PVC/PVA copolymer and said resin solution contains an additive comprising silver flakes.

10. A model comprising a framework, and a covering sheet according to claim 1 bonded to said framework.

11. A model according to claim 10 comprising a model aircraft, wherein said framework is of balsa wood.

12. A method of covering the framework of a model aircraft comprising, providing said framework, and bonding to said framework a covering sheet material, said covering sheet material comprising a fibrous scrim having a weight not exceeding 40 grm/m$^2$, wherein said fibrous scrim has been impregnated with a resin solution, said resin solution containing a cross-linking agent and a catalyst, the cross-linking agent serving to cross-link the resin and the catalyst serving to promote curing, the resin being at least partially cured.

13. A method according to claim 12 comprising incorporating into said resin solution an additive prior to bonding said sheet material to said framework.

14. A method according to claim 12 comprising impregnating said fibrous scrim with said resin solution at least 48 hours prior to bonding said sheet material to said framework.

15. A method according to claim 12 wherein said bonding step comprises coating said framework with a heat seal adhesive, allowing said adhesive coating to dry, applying said covering sheet material to said coated framework and applying heat thereto to bond said covering sheet material to said framework.

16. A method according to claim 15, wherein said heat application step comprises heating said covered framework to substantially 110° C.

17. A method according to claim 16 wherein said heat application step comprises ironing said covering sheet material onto said coated framework.

18. A method according to claim 12 comprising tautening said covering sheet material on said framework by applying heat thereto.

19. A method according to claim 18 wherein said tautening step comprises heating said covering sheet material to between 150° C. and 170 ° C.

* * * * *